US006328255B1

(12) United States Patent
Moody et al.

(10) Patent No.: US 6,328,255 B1
(45) Date of Patent: Dec. 11, 2001

(54) METHOD AND APPARATUS FOR CONVERTING A TOILET TISSUE ROLL DISPENSER FROM A CONCURRENT-ROLL DISPENSING MODE TO A SEQUENTIAL-ROLL DISPENSING MODE

(75) Inventors: John R. Moody, Neenah, WI (US); Victor M. Hodges, Crystal Lake, IL (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/586,973

(22) Filed: Jun. 5, 2000

(51) Int. Cl.[7] ..... B65H 16/06

(52) U.S. Cl. ..... 242/598.6; 242/598.5; 242/560.3; 242/560; 242/561

(58) Field of Search ..... 242/560, 560.3, 242/561, 598.6

(56) References Cited

U.S. PATENT DOCUMENTS 3,824,953 * 7/1974 Boone ..... 118/75
4,004,687 * 1/1977 Boone ..... 206/233
5,288,032 * 2/1994 Boone et al. ..... 242/560.3

* cited by examiner

*Primary Examiner*—Donald P. Walsh
*Assistant Examiner*—Jonathan R. Miller
(74) *Attorney, Agent, or Firm*—Burns, Doane, Swecker & Mathis, LLP

(57) ABSTRACT

A toilet tissue dispensing mechanism includes a unit formed by a pair of parallel vertical walls. Each wall includes vertically spaced openings arranged such that the openings of each wall are in vertically staggered relationship with the openings of the other wall when the movable wall is closed. Each opening has a roll-mounting structure associated therewith, whereby each wall is capable of concurrently dispensing a pair of tissue rolls. Each roll-mounting structure includes a shield mounted for swinging movement between open and closed positions for securing the rolls in their respective openings. To convert such a mechanism to a dispenser which dispenses rolls sequentially rather than concurrently, the shields are swung to their open positions, and adapter plates are positioned against inside surfaces of respective ones of the walls to cover the openings therein. The plates are pressed against the respective walls by edges of the shields. Sequential-roll dispensers are then attached to exterior surfaces of the plates.

10 Claims, 6 Drawing Sheets

METHOD AND APPARATUS FOR CONVERTING A TOILET TISSUE ROLL DISPENSER FROM A CONCURRENT-ROLL DISPENSING MODE TO A SEQUENTIAL-ROLL DISPENSING MODE

The present invention relates to toilet tissue dispensers and, in particular, to methods and apparatus for converting such a dispenser from a concurrent roll dispensing mode to a sequential roll dispensing mode.

Depicted in FIGS. 1–2 is a prior art toilet paper dispensing unit 10 which is mounted in a divider panel 12 that separates adjacent toilet stalls in a restroom. The dispensing unit 10 comprises a pair of parallel vertical walls 14, 16 spaced apart to define therebetween an internal chamber. Disposed within the internal chamber are rolls 18 of toilet tissue which project from openings 20A–D formed in respective walls 14, 16 to be accessible to users. Each wall includes two openings to dispense two rolls concurrently. One of the walls 14 is hinged along a vertical edge and can be swung open to provide access to the internal chamber for replacement of the rolls, as shown in FIG. 2.

Since the dispensing unit 10 is built into the divider panel 12, it may be necessary to replace that unit 10 in the event that it is desired to provide a different type of dispensing mechanism, e.g. a sequential-dispensing mechanism that dispenses a new toilet tissue roll after a previous roll has been used up.

It would be desirable to provide a simpler and less costly way of making such a conversion, and to effect the conversion in a way that can be easily reversed, if desired to return to the original current-dispensing mode.

SUMMARY OF THE INVENTION

A method aspect of the present invention involves converting a toilet tissue dispensing mechanism from a concurrent roll dispensing mode to a sequential roll dispensing mode. The tissue dispensing mechanism comprises a unit formed by a pair of parallel vertical walls enclosing an interior chamber therebetween. One of the walls is movable between open and closed positions. Each wall includes vertically spaced openings arranged as such that the openings of each wall are in vertically staggered relationship with the openings of the other wall when the movable wall is closed. Each opening has a roll-mounting structure associated therewith. Each roll-mounting structure is disposed in the chamber and includes a shield mounted for swinging movement between open and closed positions. The method comprises the steps of:

A. opening the movable wall;

B. swinging the shields to their open positions;

C. positioning adapter plates against inside surfaces of respective ones of the walls to cover the openings of the respective walls;

D. closing the movable wall such that the shields are secured in their closed positions, with edges of the shields engaging interior surfaces of respective ones of the adapter plates to push the adapter plates against respective ones of the walls; and E. attaching sequential roll dispensers to exterior surfaces of respective adapter plates.

An apparatus aspect of the invention relates to a sequential roll dispensing mechanism which comprises a unit formed by a pair of parallel vertical walls enclosing an interior chamber therebetween. One of the walls is movable between open and closed positions. Each wall includes vertically spaced openings arranged such that the openings of each wall are in vertically staggered relationship with the openings in the other wall when the movable wall is closed. Each opening has a roll-mounting structure associated therewith. Each roll-mounting structure is disposed in the chamber and includes a shield mounted to swinging movement between open and closed positions. Adapter plates are positioned against inside surfaces of respective ones of the walls and are pressed thereagainst by edges of the shields. The adapter plates cover the openings in the respective walls. Sequential roll dispensers are mounted to exterior surfaces of respective adapter plates.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF A PREFERRED EMBODIMENT OF THE INVENTION

Figure 1:
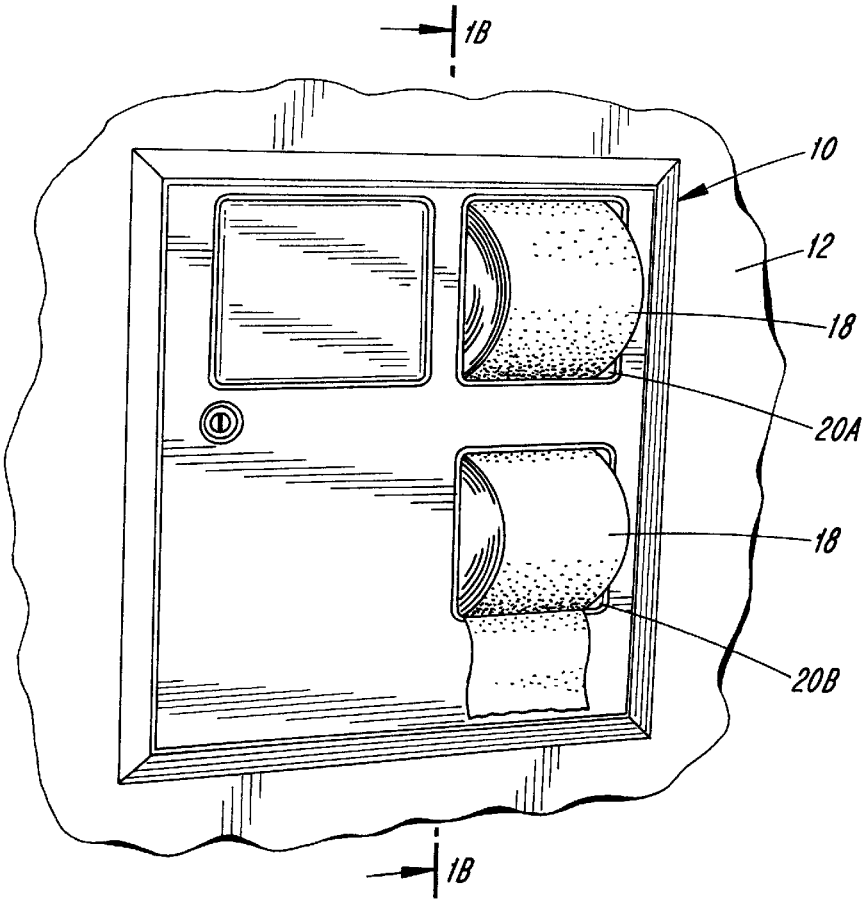
FIG. 1 (PRIOR ART)
FIG. 1 is a perspective view of a prior art toilet tissue roll dispenser for dispensing rolls concurrently.
Figure 2:
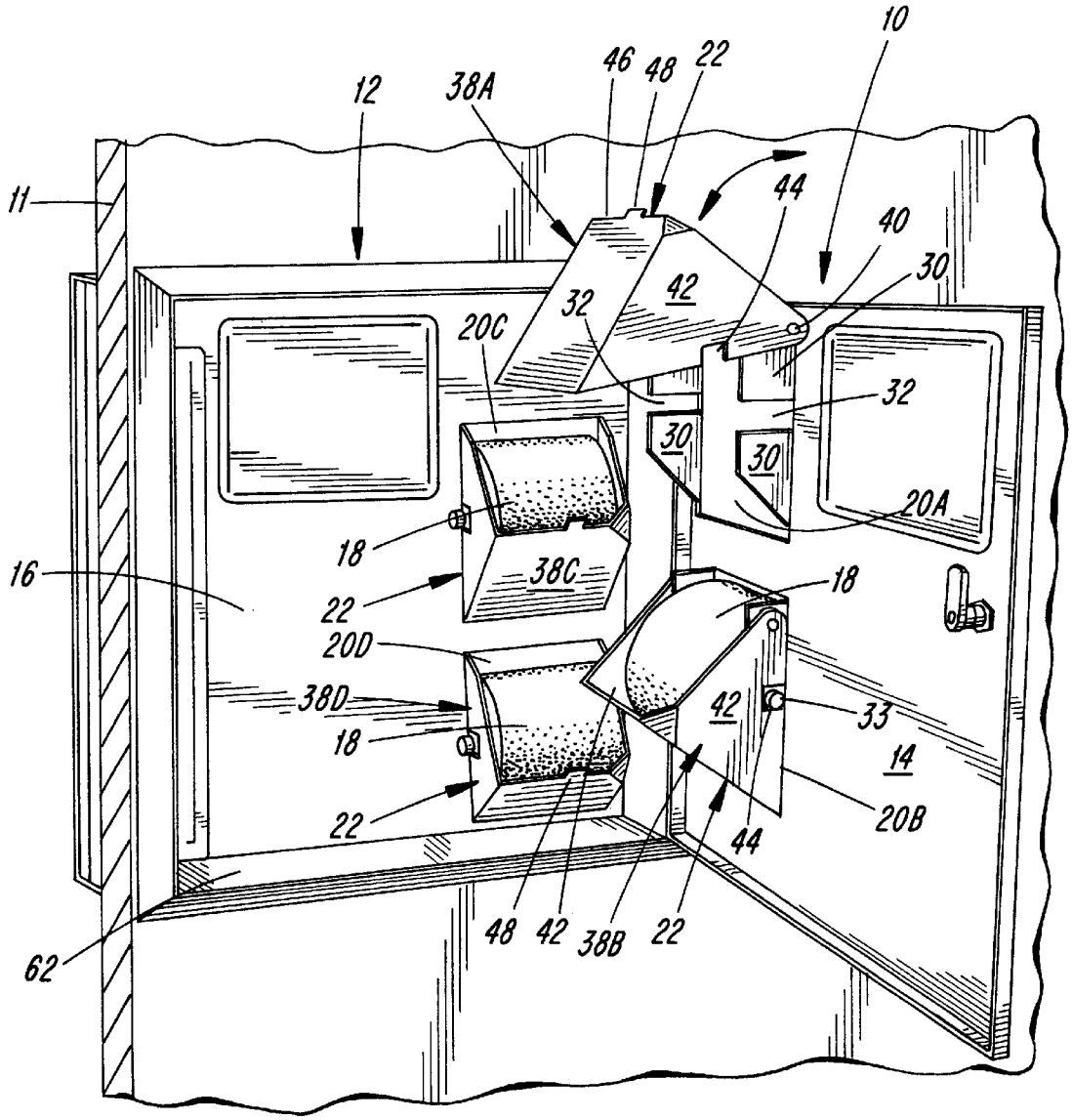
FIG. 2 (PRIOR ART)
FIG. 2 is a view similar to FIG. 1 after a door of the dispenser has been opened.

Depicted in FIGS. 1–2 is the previously described prior art toilet tissue roll dispensing unit 10 which is built into a divider panel 12 separating adjacent toilet stalls in a restroom. The dispensing unit 10 includes a pair of parallel vertical walls 14, 16 spaced apart to define therebetween an internal chamber. Disposed within the internal chamber are rolls 18 of toilet tissue which are accessible to users through openings 20A–D formed in the walls.

Figure 1B:
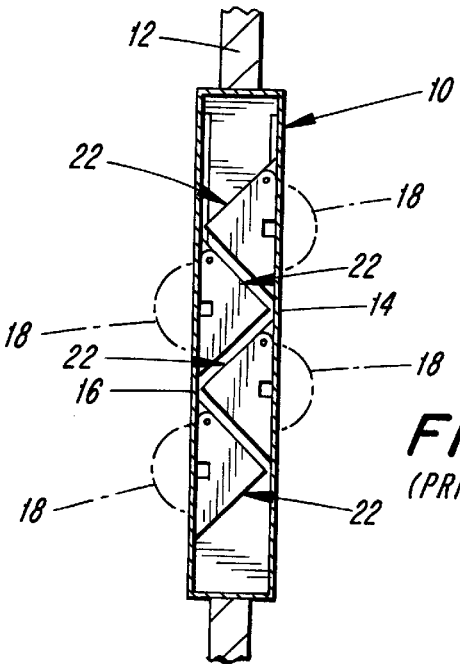
FIG. 1B (PRIOR ART)
FIG. 1B is a sectional view taken along line 1B—1B in FIG. 1.

Each wall possesses two of the openings, whereby each roll dispenses two rolls 18 concurrently. The openings in each wall are arranged one above the other, and are vertically staggered with respect to the openings in the other wall (see FIG. 1B).

One of the walls 14 is hinged along one vertical edge, so that such wall 14 constitutes a door that can be swung open to access the internal chamber for replacing rolls 18.

Mounted on inner surfaces of both walls 14, 16 adjacent to respective ones of the openings 20A–D are identical roll-mounting structures 22. As can be seen in FIG. 2, the roll-mounting structure 22 associated with the opening 20A comprises pairs of horizontally inwardly projecting legs 30 disposed along opposite edges of (i.e., straddling) the opening 20A. Each pair of legs 30 is spaced apart vertically to form an inwardly open slot 32. The two slots 32 are disposed at a common elevation, so that the respective ends of a tissue mandrel 33 can be inserted therein.

A shield 38A is mounted adjacent the opening 20A for rotation about a horizontal hinge 40 disposed above the opening 20A. The shield can thus be swung between a lower closed position covering the opening, and an upper open position exposing the opening. The shield includes sidewalls 42 in which are disposed respective outwardly open slots 44. The side wall 42 has a V-shaped or wedge-shaped profile. When the shield is in a closed position, those slots 42 overlap respective slots 32 formed in the legs 30, whereby the tissue mandrel 33 is locked against accidental removal.

Each of the openings 20A–D has a shield associated therewith, wherein the four shields 38A–D, like the openings 20A–D, are staggered vertically with respect to one another. When the wall 14 is closed, the shields 38A–D are thus arranged sequentially in the vertical direction, one above the other (see FIG. 1B). Inner edges 46 of the shields include fingers 48, each finger projecting from a midpoint of its respective edge 46. Each finger engages an opposite one of the walls 14, 16 to hold the shields in their downward positions when the wall 14 is closed.

Tissue rolls 18 can be replaced by opening the wall 14, raising the respective shields 38A–D, removing the mandrel (s) of the spent roll(s), and inserting full roll(s) in their place, enabling multiple rolls to be dispensed concurrently.

Figure 3:
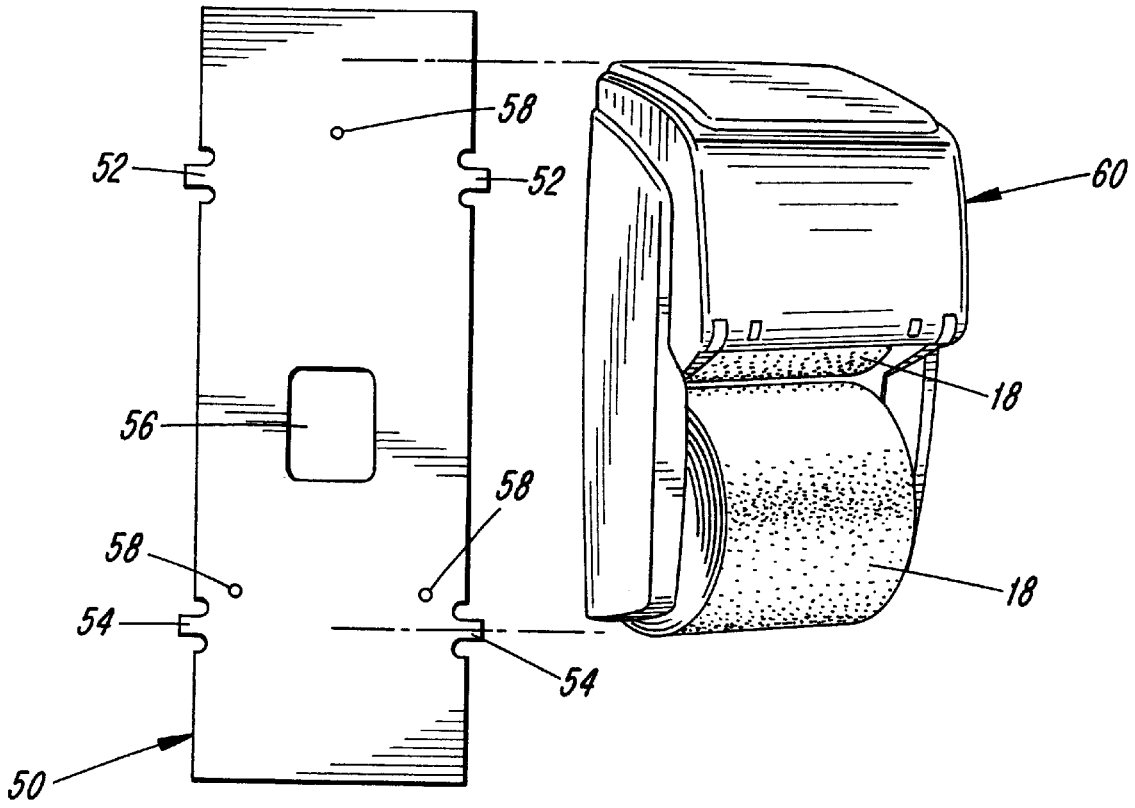
FIG. 3 is a front elevational view of an adapter plate according to the invention and a perspective view of a conventional sequential-roll dispenser to be mounted on the adapter plate.

In order to convert the above-described prior art dispensing unit 10 from a concurrent roll dispensing mode to a sequential roll dispensing mode, i.e., a mode in which a new roll is dispensed after a previous roll has been used up, an adapter plate 50 is provided, as shown in FIG. 3. The adapter plate 50 is formed of a rigid material, such as stiff plastic or metal, and includes two vertically spaced pairs of outwardly projecting tabs 52, 54, a center aperture 56, and screw holes 58. The screw holes 58 are pre-positioned to conform to the location of respective screw holes on a conventional tissue dispenser, such as a sequential roll dispenser 60. That dispenser 60 is adapted to position two toilet tissue rolls 18 in vertically adjacent relationship. When a lower one of the rolls has been used up, the upper roll automatically drops downward to a dispensing position.

Figure 4:
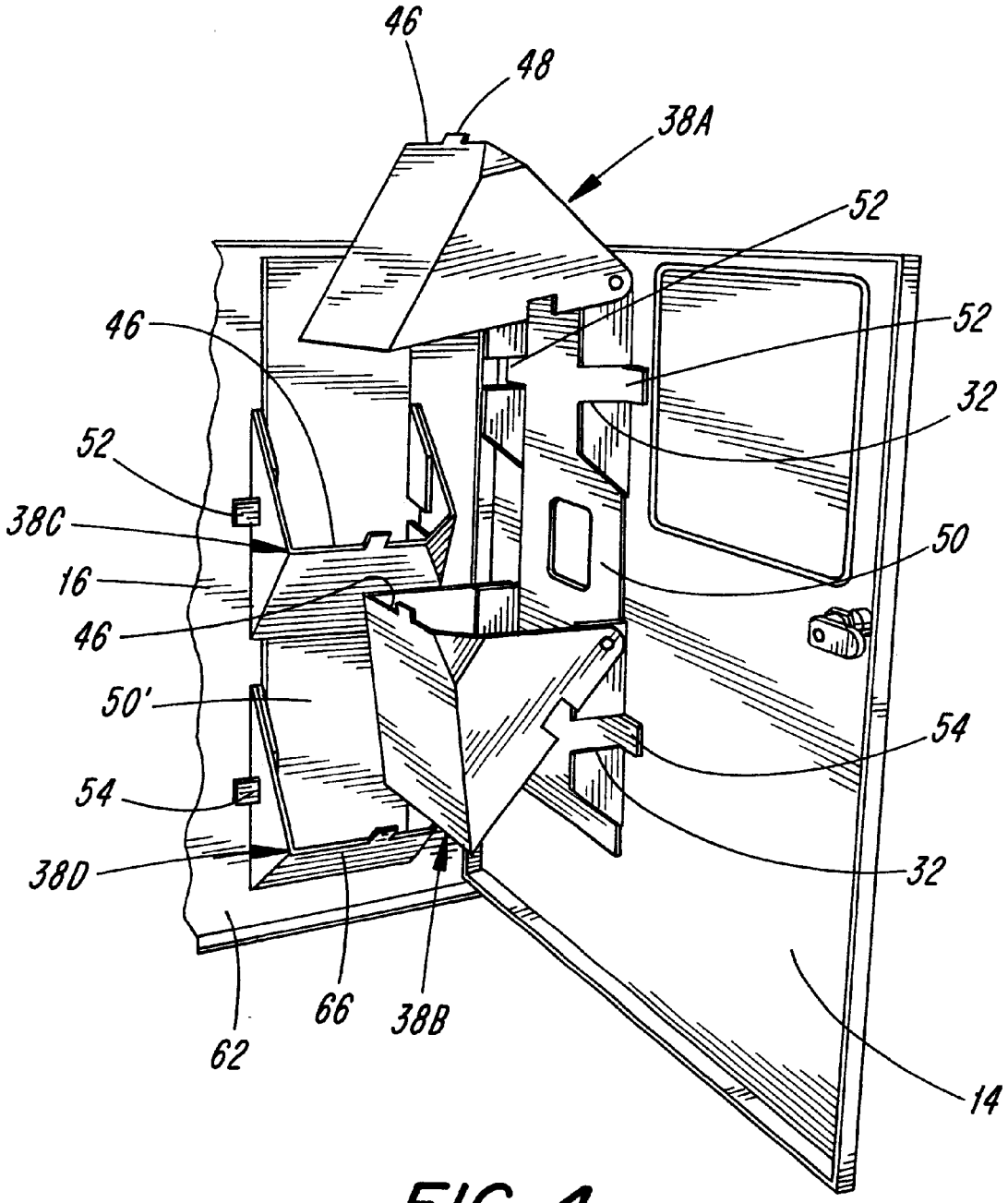
FIG. 4 is a fragmentary view of FIG. 2 after two of the adapter plates of FIG. 3 have been mounted therein.

The adapter plate 50 is to be mounted in the wall 14, and an identical adapter plate 50' is to be mounted in the wall 16 (see FIG. 4). Mounting of the adapter plate 50 in the wall 14 is accomplished by opening the wall 14, raising the shields 38A, 38B, and inserting the upper pair of tabs 52 into the slots 32 associated with the upper opening 38A, and inserting the lower pair of tabs 54 into the slots 32 associated with the lower opening 38B. The plate 50' is similarly mounted in the back wall 16, except that the bottom edge of that plate 50' can rest upon a bottom shelf 62 of the back wall 16 since the plate 50' will be situated somewhat lower than the plate 50 when installed. The plates 50, 50' are configured to extend completely across the openings 38A–D.

After the plates 50, 50' have been thus installed, the shields 38A–D are lowered, and the door 14 is closed. In this state, inner edges 46 of the shields are pressed against inside surfaces of an opposite plate 50 or 50', thereby forcing the plates tightly against interior surfaces of the walls 14, 16. The center apertures 56 of the plates 50, 50' provide areas in which the fingers 48 of the inner edges 46 of the shields can enter to avoid interfering with the closing of the wall 14.

Figure 5:
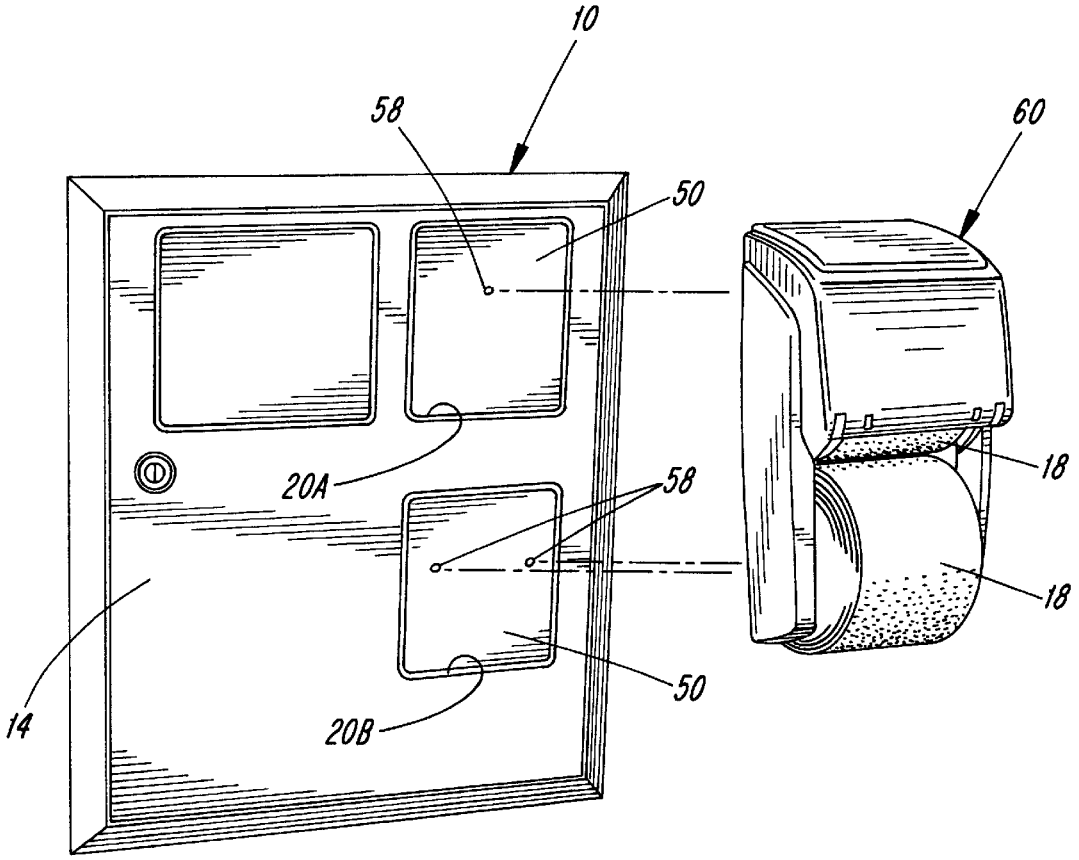
FIG. 5 depicts an external surface of the dispenser after the adapter plates have been mounted and the door has been closed, and the sequential-roll dispenser is depicted in the process of being mounted on an exterior surface of a mounting plate.
Figure 6:
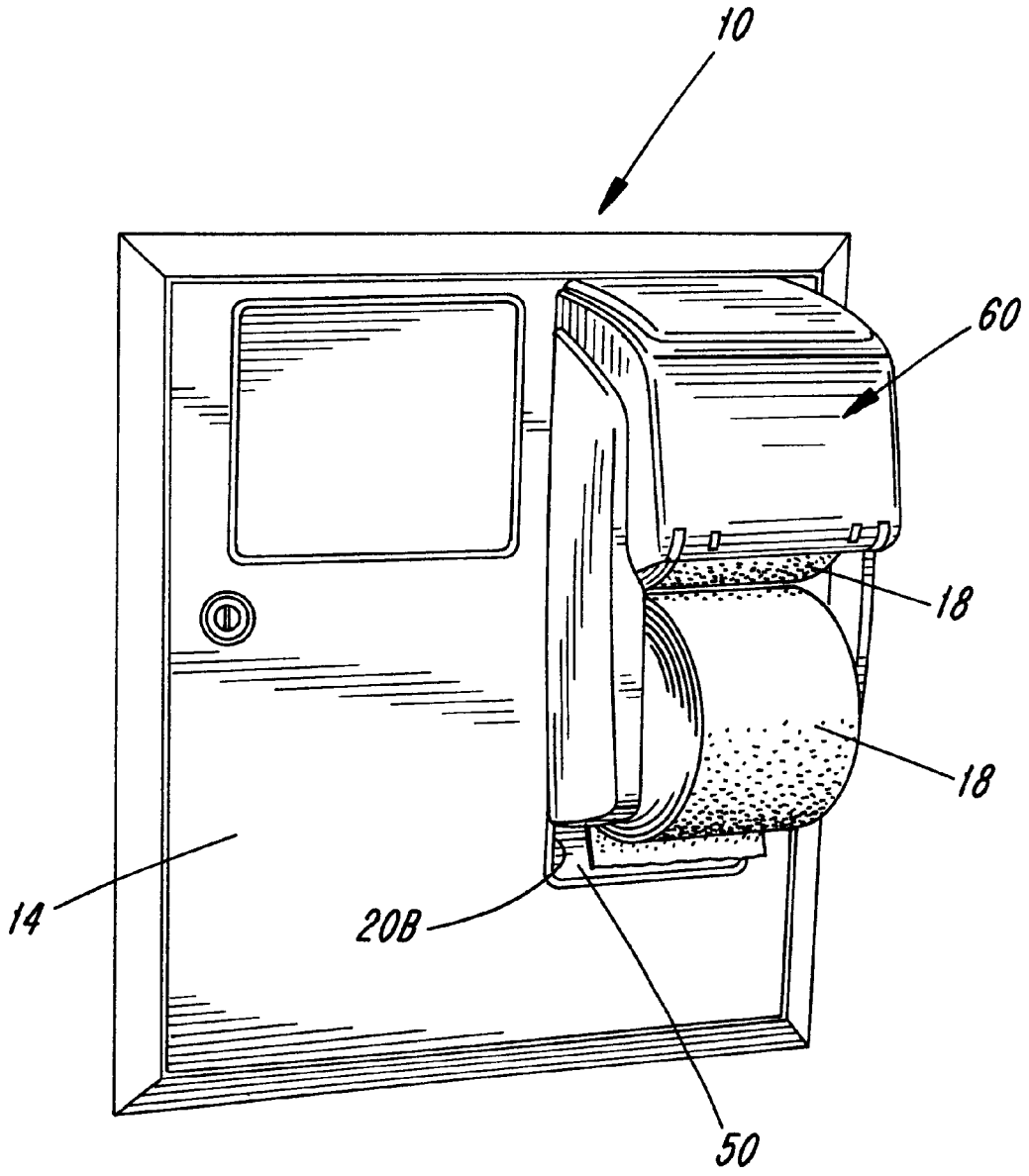
FIG. 6 is a view similar to FIG. 5 after the sequential-roll dispenser has been mounted.

Then, a dispenser 60 is attached to the exterior surface of each of the plates 50, 50' (see FIGS. 5–6). This is accomplished by positioning each dispenser 60 so that screw holes thereof are aligned with respective pre-drilled screw holes 58 in the plate 50 or 50'. By installing screws, the dispensers 60 become secured to the respective plates 50, 50'.

It will be appreciated that the conversion can be done quickly and easily, at relatively little cost. To undo (reverse) the conversion, whereby the dispensing mechanism can once again dispense rolls concurrently, it is merely necessary to reverse the above-described steps.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of converting a toilet tissue dispensing mechanism from a concurrent-roll dispensing mode to a sequential-roll dispensing mode, the tissue dispensing mechanism comprising a unit formed by a pair of parallel vertical walls enclosing an interior chamber therebetween, one of the walls being movable between open and closed positions, each wall including vertically spaced openings arranged such that the openings of each wall are in vertically staggered relationship with the opening of the other wall when the movable wall is closed, each opening having a roll-mounting structure associated therewith, each roll-mounting structure disposed in the chamber and including a shield mounted for swinging movement between open and closed positions, the method comprising the steps of:

A. opening the movable wall;

B. swinging the shields to their open positions;

C. positioning adapter plates against inside surfaces of respective ones of the walls to cover the openings of the respective walls;

D. closing the movable wall such that the shields are secured in their closed positions, with edges of the shields engaging interior surfaces of respective ones of the adapter plates to push the adapter plates against respective ones of the walls; and E. attaching sequential-roll dispensers to exterior surfaces of respective adapter plates.

2. The method according to claim 1 wherein an interior surface of each of the walls includes legs straddling each opening and projecting horizontally inwardly, each adapter plate including outwardly projecting tabs, step C further including positioning the adapter plates such that the tabs engage the legs.

3. The method according to claim 2 wherein the legs form inwardly open slots, step C further including positioning the tabs in respective ones of the slots.

4. The method according to claim 3 wherein each adapter plate includes pre-formed screw holes, step E further including positioning each sequential roll dispenser such that screw holes in the dispenser are aligned with respective ones of the screw holes in the plate, and inserting screws therethrough.

5. The method according to claim 1 wherein each adapter plate includes pre-formed screw holes, step E further including positioning each sequential roll dispenser such that screw holes in the dispenser are aligned with respective ones of the screw holes in the plate, and inserting screws therethrough.

6. A sequential-roll dispensing mechanism comprising a unit formed by a pair of parallel vertical walls enclosing an interior chamber therebetween, one of the walls being movable between open and closed positions, each wall including vertically spaced openings arranged such that the openings of each wall are in vertically staggered relationship with the openings in the other wall when the movable wall is closed, each opening having a roll-mounting structure associated therewith, each roll-mounting structure disposed in the chamber and including a shield mounted for swinging movement between open and closed positions, adapter plates positioned against inside surfaces of respective ones of the walls and pressed thereagainst by edges of the shields, the adapter plates covering the openings in the respective walls, and sequential-roll dispensers mounted to exterior surfaces of respective adapter plates.

7. The mechanism according to claim 6 wherein the interior surface of each of the walls includes legs projecting horizontally inwardly adjacent respective vertical edges of each opening, each adapter plate including outwardly projecting tabs engaging the legs.

8. The mechanism according to claim 7 wherein the legs form inwardly open slots, with the tabs disposed in respective ones of the slots.

9. The mechanism according to claim 8 wherein each adapter plate includes pre-formed screw holes, with the sequential roll dispenser secured by screws received in such screw holes.

10. The mechanism according to claim 6 wherein each adapter plate includes preformed screw holes, with the sequential roll dispenser secured by screws received in such screw holes.

* * * * *